United States Patent [19]

Gilmore

[11] Patent Number: 4,817,758

[45] Date of Patent: Apr. 4, 1989

[54] WINDOW CLEANING SUPPORT STRUCTURE

[76] Inventor: James E. Gilmore, P.O. Box 2074, Livermore, Calif. 94550

[21] Appl. No.: 157,042

[22] Filed: Feb. 16, 1988

[51] Int. Cl.[4] ..... E04G 3/10

[52] U.S. Cl. ..... 182/16; 182/63; 182/142; 182/150; 248/237

[58] Field of Search ..... 182/142, 143, 144, 63, 182/36, 150, 145, 16; 248/237

[56] References Cited

U.S. PATENT DOCUMENTS

| | | | |
|---|---|---|---|
| 3,608,670 | 9/1971 | Blake | 182/142 |
| 3,854,550 | 12/1974 | Shingler | 182/142 |
| 4,096,922 | 6/1978 | Fisher | 182/142 |
| 4,130,179 | 12/1978 | Williams | 182/142 |
| 4,234,055 | 11/1980 | Beeche | 182/142 |
| 4,274,507 | 6/1981 | Williams | 182/142 |
| 4,496,027 | 1/1985 | Fisher | 248/237 |

OTHER PUBLICATIONS

An advertising brochure by Fitch Enterprises of Council Bluffs, Iowa, Date unknown.

*Primary Examiner*—Reinaldo P. Machado
*Attorney, Agent, or Firm*—Limbach, Limbach & Sutton

[57] ABSTRACT

A support structure for suspending a window washer from the top of a building is disclosed. The support structure includes a counterweight carriage, a center support, a beam affixed to the counterweight carriage and the center support, and means for suspending the window washer from the outward end of the beam. The counterweight carriage has a frame member, a ballast container, and at least three wheels that allow the counterweight carriage to roll along the roof. The counterweight carriage further includes a steering mechanism to facilitate moving the carriage and support structure around on the roof.

10 Claims, 3 Drawing Sheets

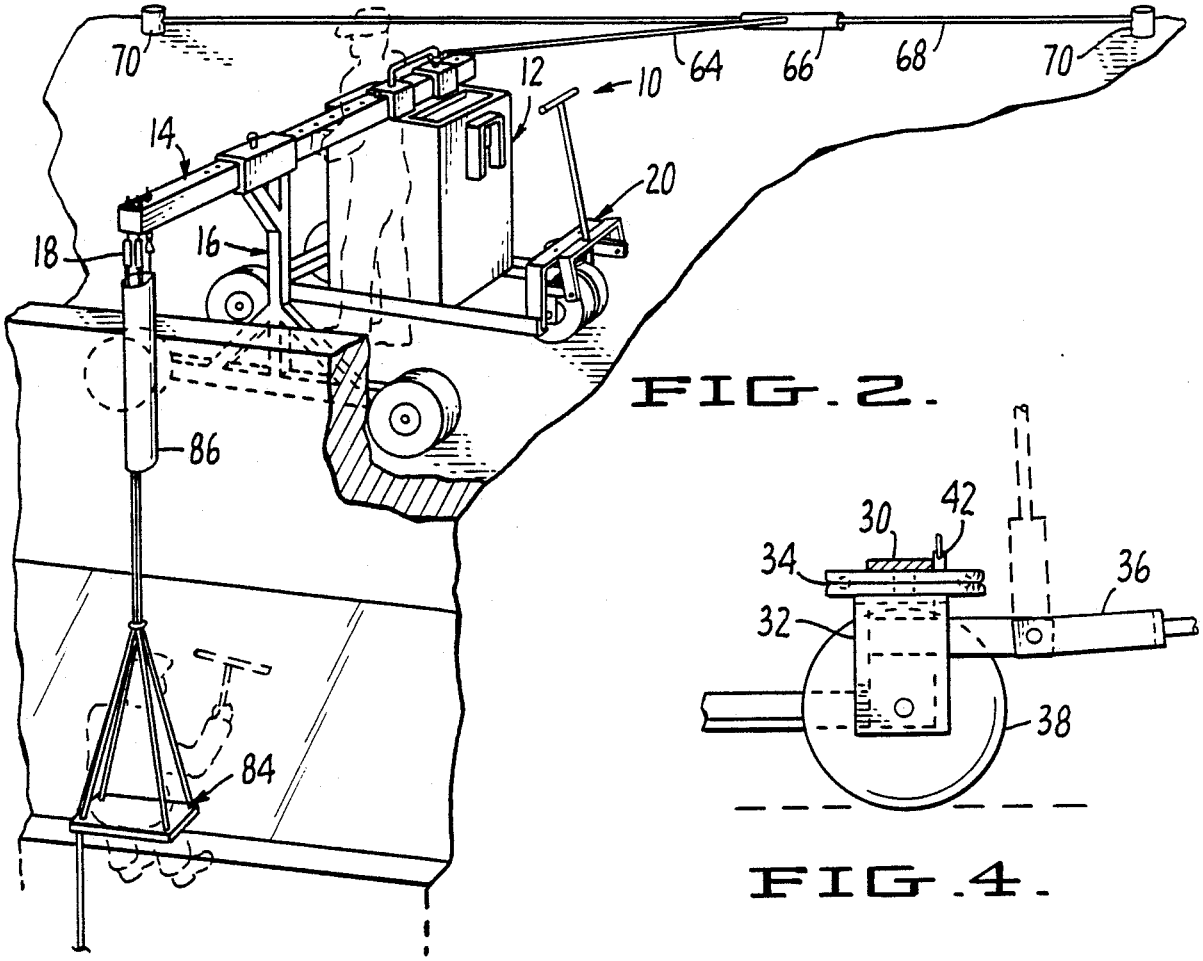
FIG. 2.
FIG. 4.
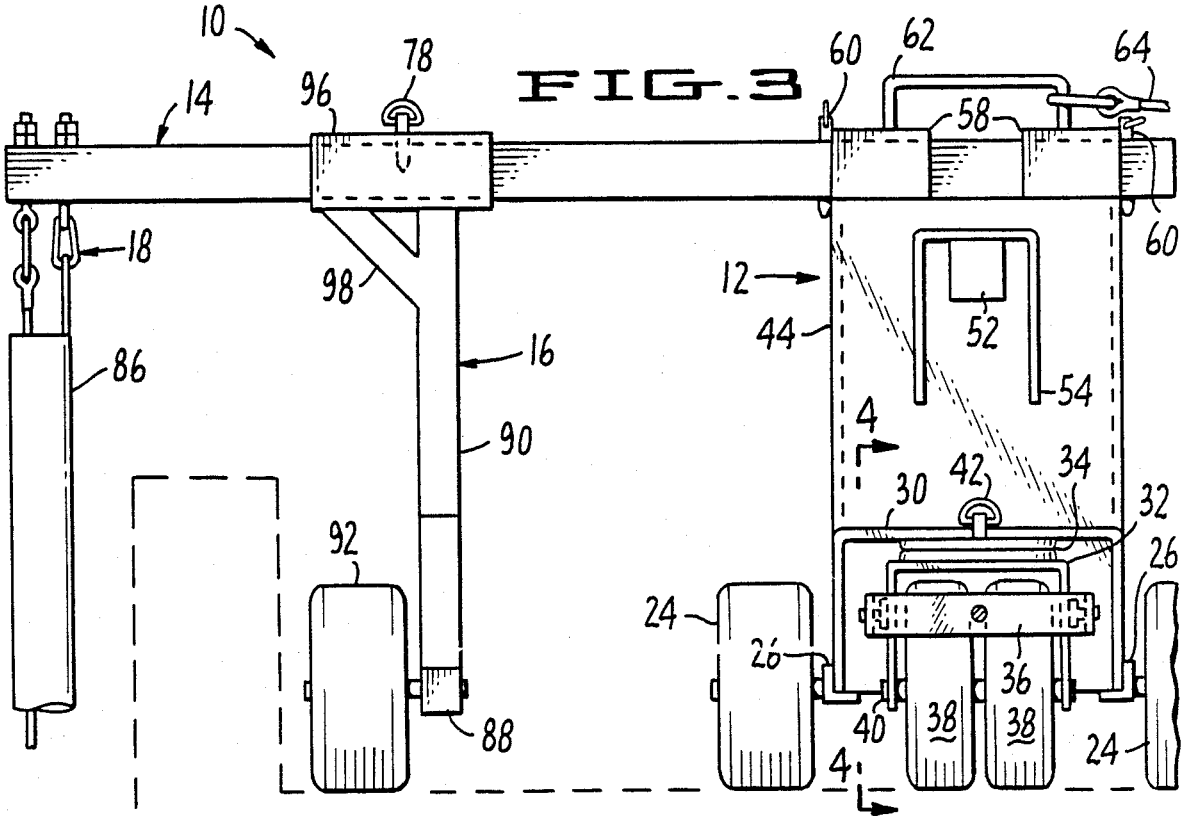
FIG. 3

WINDOW CLEANING SUPPORT STRUCTURE

BACKGROUND OF THE INVENTION

1. Field of the Invention

This invention relates generally to devices for suspending a person from the roof of a building, and relates more particularly to a wheel-mounted counterbalance support structure that can be rolled along the edge of the roof to facilitate the washing of the windows of the building.

2. Description of the Relevant Art

The task of washing or cleaning the windows of a building of more than a few stories in height involves the suspension of a person from the roof of the building. The person, a window washer, typically starts at the top of the building and gradually lowers himself downward, washing windows on the way. The window washer is suspended from above by a boatswains chair or other platform that is supported from above by one or more suspension ropes. The topside of the suspension ropes is secured in some fashion to the building or other structure.

Traditionally, the topside of the suspension ropes have been secured to davits that are fastened to the roof of the building and project over the edge of the roof. This securing arrangement is satisfactory in terms of safety, but can be expensive in implementation and inconvenient in use. In implementation, the providing of a sufficient number of sockets for mounting the davits can be expensive, especially if not planned into the construction of the building from the beginning. In use, the window washer and his suspension rig are confined to vertical movement and the suspension rig must be reattached to a different location on the roof after each vertical pass. The reattachment involves a good deal of lost production time while the window washer travels between the ground and roof levels and reattaches the suspension rig. The lost cleaning time caused by the reattachment of the suspension rig is especially a problem in low and medium height buildings where the repositioning of the suspension rig can involve a large percentage of the time required to wash the windows of the buildings due to the limited number of windows that can be washed during each vertical pass.

As an alternative to securing the suspension ropes and rig to davits, one company has offered a wheel-mounted support apparatus that can be moved around on the roof. This wheel-mounted support apparatus has a beam that at one end hangs over the edge of the building and provides an attachment point for the window washer's suspension rig. Inward from the attachment end of the beam is one wheeled support that rides on or close to the parapet. At the other end of the beam is a second wheeled support and means for attaching a counterweight. Both of the wheeled supports have two in-line wheels that are parallel to the edge of the roof. The counterweight is a block of concrete that is suspended from the inward end of the beam. The entire structure is designed for easy disassembly so that the apparatus can be moved to other job sites. Accordingly, the four wheels are mounted to legs, each of which is separately and removably attached to the beam.

In use, this wheel-mounted apparatus does overcome some of the disadvantages of using davits to secure the suspension rig, but introduces some disadvantages of its own. The wheels allow the apparatus to be pushed parallel to the edge of the roof by an operator stationed on the roof, but do not allow the apparatus to manuever around obstacles on the roof, such as heating and air conditioning structures, skylights, etc. The removability of the legs, unfortunately compromises the safety of the apparatus for the purpose of transportability between job sites. Also, the counterweight is not securely attached and if it should happen to fall off, the safety of the window washer will be in serious jeopardy.

SUMMARY OF THE INVENTION

In accordance with the illustrated preferred embodiment, the present invention provides a support structure for supporting an object suspended from the top of a building having a substantially flat roof. The support structure includes a counterweight carriage, a beam, a center support, and means for suspending an object from the outward end of the beam. The counterweight carriage has a frame member and at least three wheels that allow the counterweight carriage to roll along the roof. The counterweight carriage further includes a steering mechanism to facilitate moving the carriage and support structure around on the roof. A ballast container is mounted to the frame and, at the top of the ballast container, a box section is provided for securely coupling to the beam. The beam is securely coupled to the counterweight carriage at an inward end and is disposed substantially horizontally and transversely to the direction of travel of the counterweight carriage. The outward end of the beam extends over the edge of the roof when in use. The center support, securely coupled to the beam at a position between the inward and outward ends thereof, is operable for supporting the center of the beam. The center support includes a horizontal frame member disposed transversely to the beam and a vertical frame member extending upwardly from the center of the horizontal member. The center support further includes two wheels each rotatably mounted to an end of the horizontal frame member and operable for allowing the center support to roll along with the counterweight carriage and beam along the roof. The center support further includes a box section disposed at the top of the vertical frame member for securely coupling to the beam.

The support structure of the present invention provides several advantages in comparison to prior art wheel-mounted support apparatus. First, the steering mechanism of the counterweight carriage allows an operator stationed on the roof to easily maneuver the support structure around obstructions on the roof. Second, the safety aspects are improved significantly by providing welded frames for the wheeled supports and a massive counterweight carriage.

BRIEF DESCRIPTION OF THE DRAWINGS

FIG. 2 is a perspective view of the support structure of the present invention in use as a device for suspending a window washer from the roof of a building.

FIG. 3 is a side elevation view of the present invention.

FIG. 4 is a detail view, partially in section, of a steering mechanism of the present invention.

DETAILED DESCRIPTION OF THE PREFERRED EMBODIMENTS

FIGS. 1 through 7 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
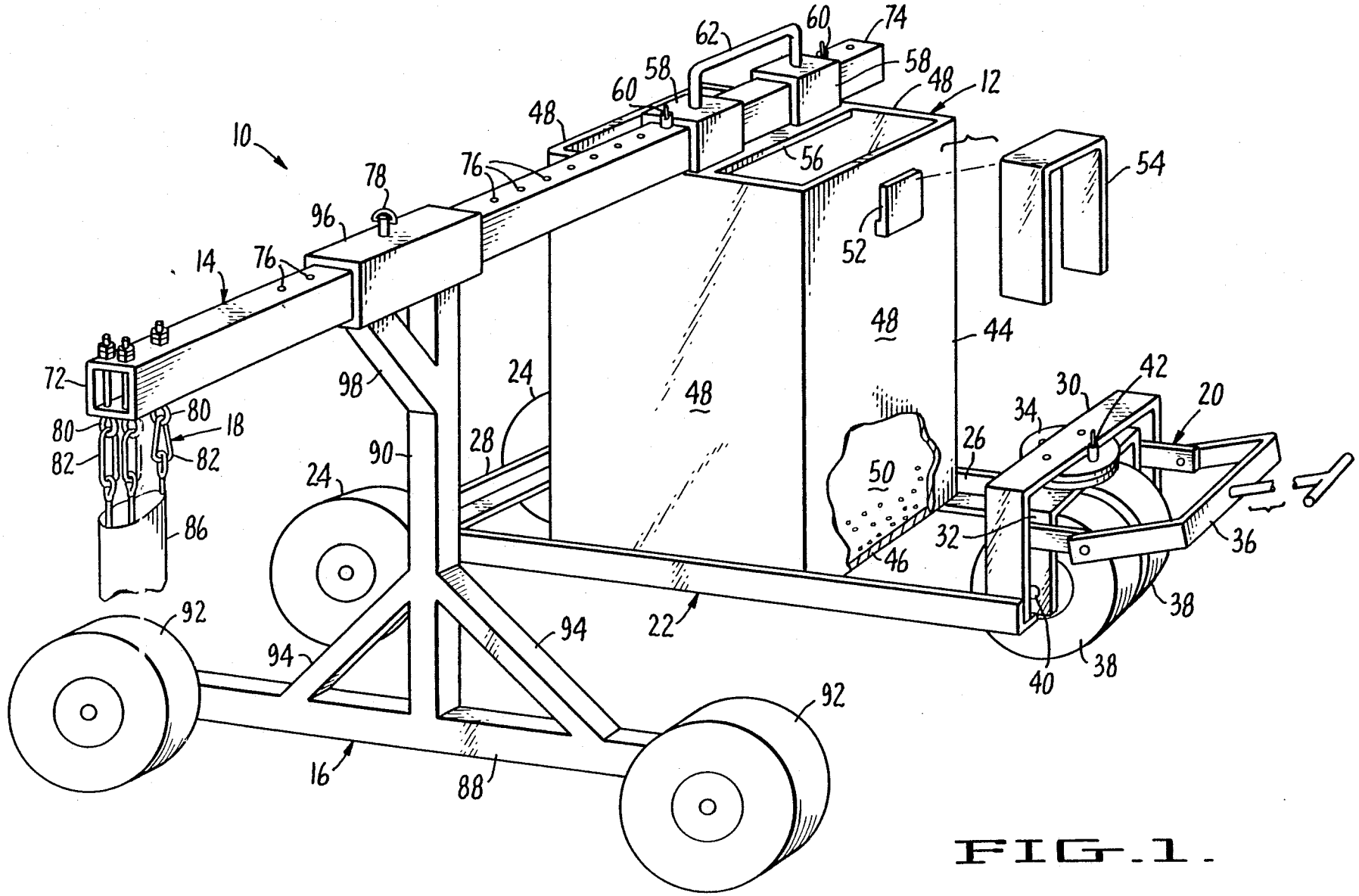
FIG. 1 is a perspective view of a wheel-mounted counterbalance support structure in accordance with the present invention.

The preferred embodiment of the present invention is a wheel-mounted support structure that can be rolled along the edge of the roof and intended for suspending a window washer over the edge of the building. As shown in FIG. 1, the support structure 10 generally includes a counterweight carriage 12, a beam 14, a center support 16, and hooks 18. Key features to be noted are the welded construction of the counterweight carriage 12 and center support 16, as well as the steering mechanism 20 of the counterweight carriage.

The counterweight carriage 12 has a lower frame 22, with two wheels 24 rotatably mounted to one end of the frame and the steering mechanism 20 mounted to the other end of the frame. The frame 22 consists of two side rails 26, welded at one end to a cross rail 28, and at the other end to a U-shaped cross rail 30. The wheels 24 are rotatably mounted to the frame 22 near the corner formed by cross rail 28. The steering mechanism 20 consists of a subframe 32, turntable 34, handle 36, and two wheels 38. The subframe 32 is U-shapd with the arms pointing downward. The wheels 38 are rotatably mounted via an axle 40 to the arms of the subframe 32. The turntable 34 mounts between the center span of the cross rail 30 and the subframe 32 and allows the subframe 32 and attached wheels 38 to rotate about the vertical axis of the turntable. The handle 36 is pivotally attached to the arms of the subframe 32 and, as shown best in FIG. 4, can pivot between a horizontal position and an upright position. A removable pin 42 can be installed into the turntable to lock the steering mechanism into a straight-ahead orientation.

Figure 5:
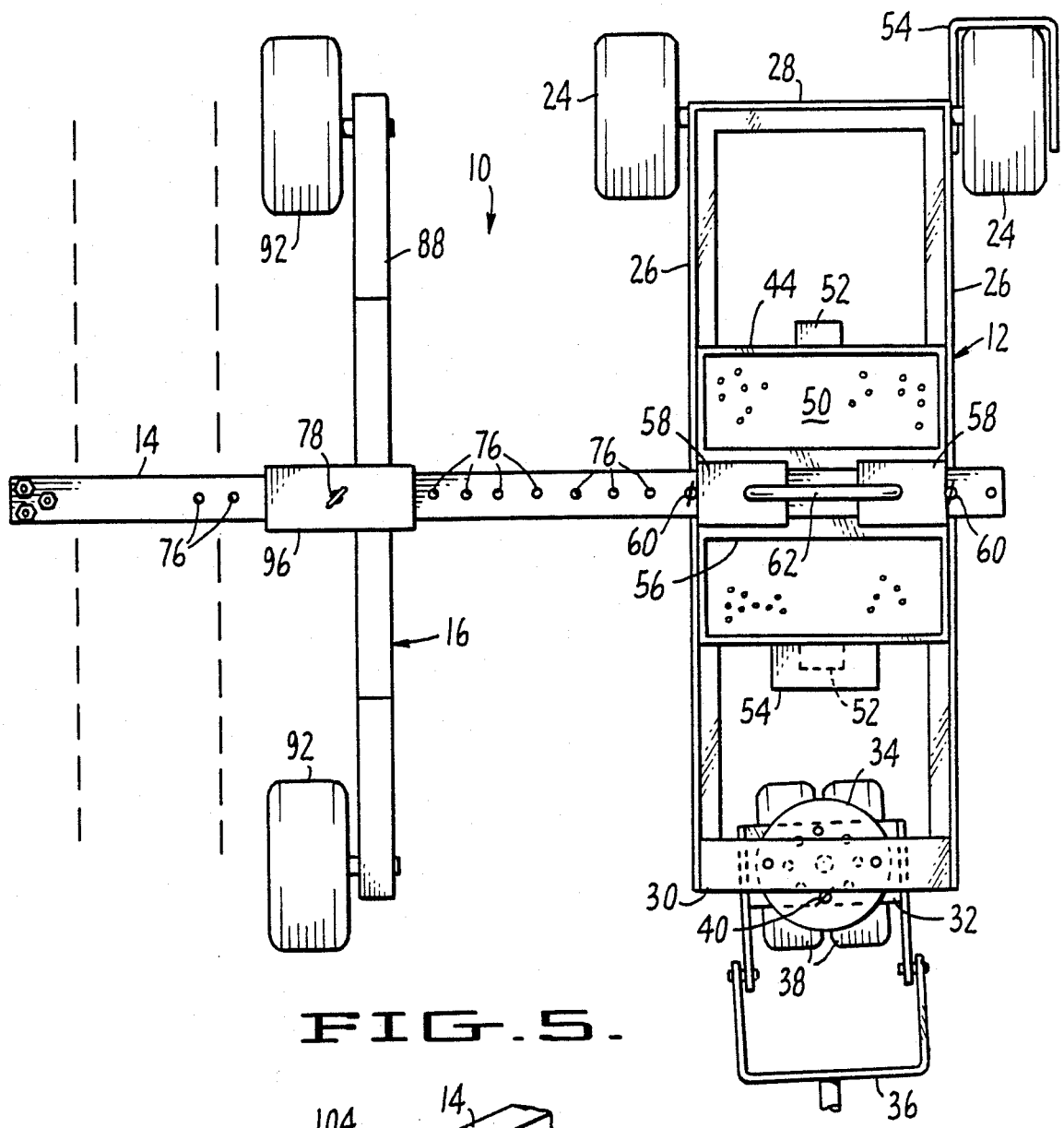
FIG. 5 is a top plan view of the present invention.

Affixed to the center of the frame 22, preferably by welding, is a ballast container 44 consisting of a base plate 46 and four sides 48 welded together into an open-top box. The ballast container 44 is intended to hold sand or other ballast material 50, loaded into the container from above. On the side of the ballast container 44 is a hook 52 which provides a handy mounting place for a wheel chock 54. The wheel chock 54, incidentally, is a three sided structure that is used to block the wheels, as shown in FIG. 5. A plate (not shown) may be inserted into and welded to the inside of the ballast container 44 to act as a lid to make sure that the ballast remains within the ballast container.

Means for attaching the beam 14 to the counterweight carriage 12 are provided at the top of the ballast container 44. A plate 56 is welded across the open top of the container and two box sections 58 are welded to the top of the plate. The box sections 58 are aligned in a direction transverse to the direction of movement of the fixed wheels 24 and are sized to be slightly larger inside than the outside dimensions of the beam 14. The beam 14 is inserted into the box sections 58 and is locked in place by two removable pins 60. A U-shaped lug 62 is welded between the two box sections 58 to provide both a point for lifting the counterweight carriage and an attachment point for a safety line.

As shown in FIG. 2, the safety line 64 is attached at one end to the lug 62 and at the other end to the building. Preferably, the attachment of the other end of the safety line 64 to the building is accomplished by attaching the end of the safety line to a sliding member 66 that slides along a line 68 that is anchored at each end 70 to the building. By using this sliding attachment, the safety line 64 can be relatively taut, while allowing for movement of the support structue along the edge of the roof.

The beam 14 is disposed in a generally horizontal attitude, transverse to the edge or the roof, with an outward end 72 extending over the edge of the building and an inward end 74 being coupled to the counterweight carriage 12. In between the two ends, the beam is coupled to the center support 16. The beam includes several holes 76 into which removable pins 60 or 78 can be inserted for securing the beam to the counterweight carriage 12 and the center support 16. At the outward end 72, three hooks 18 are provided for attachment of the suspension rig of the window washer. Each hook includes a eye-bolt 80 attached to the lower side of the beam and a carabiner hook 82 attached to the eye-bolt. The suspension rig is attached to the carabiner hook 82. Two of the hooks support ropes attached in the illustrated embodiment to a boatswains chair 84, while the other hook supports a canvas sleeve 86 that shields the ropes from the building.

The center support 16, also a welded structure, includes a horizontal beam or frame member 88 and a vertical beam or frame member 90. Wheels 92 are rotatably mounted to each end of the horizontal beam 88. The vertical beam 90 is braced by braces 94. At the top of the vertical beam 90 is a box section 96 that provides means for attaching the center support to the beam 14. The box section 96 is aligned in a direction transverse to the direction of movement of the wheels 92 and is sized to be slightly larger inside than the outside dimensions of the beam 14. The beam 14 is inserted into the box section 96 and is locked in place by the removable pins 78. A brace 98 is welded between the box section 96 and the vertical beam 90 in order to brace the box section. All wheels 24, 38, and 92 preferably have low pressure pneumatic tires.

In operation, the support structure 10 is used to support a window washer from the roof of a building. An operator stationed on the roof can push the support structure along the edge of the roof so that the window washer can clean horizontal expanses of windows. When obstructions are encountered on the roof, the steering mechanism 20 allows the roof-top operator to navigate the support structure 10 around the obstructions. The massive, welded structure of the counterweight carriage provides a large safety margin to counterbalance the suspended weight of the window and his support rig. If an addition margin of safety is needed, perhaps to meet conservative occupation safety codes, ballast can be added to the ballast container.

Figure 6:
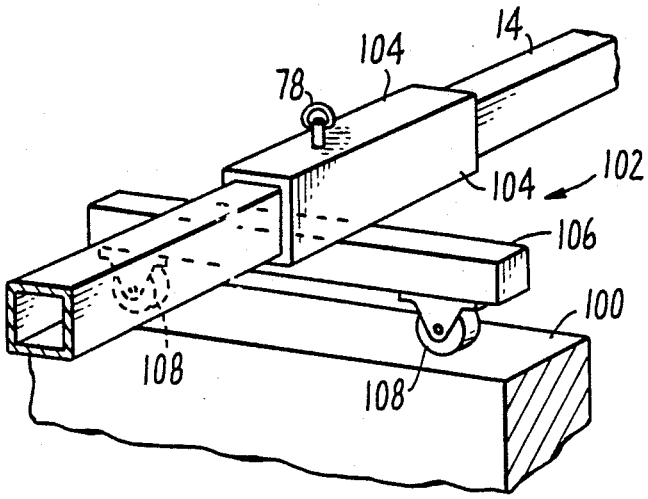
FIG. 6 is a perspective view of a parapet support in an alternative embodiment of the present invention.
Figure 7:
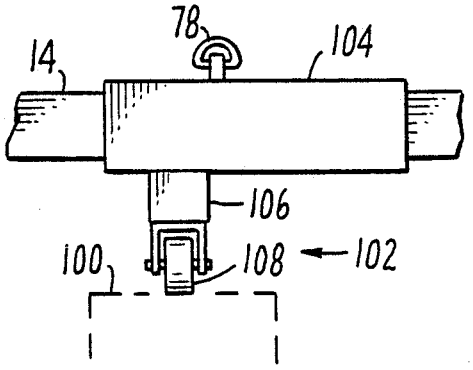
FIG. 7 is a side detail view of the alternative embodiment of FIG. 6.

An alternative embodiment of the center support is shown in FIGS. 6 and 7. In the case of a solid parapet 100, the center support can ride on top of the parapet instead of riding on the roof. In this case, the center support 102 includes a box section 104 for attachment to the beam 14, a horizontal beam 106 welded to the underside of the box section, and two castors 108 that roll along the parapet.

From the above description, it will be apparent that the invention disclosed herein provides a novel and advantageous apparatus for suspending a window washer from the top of a building. The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A support structure for supporting an object suspended from the top of a building having a substantially flat roof, said apparatus comprising:

a counterweight carriage including a frame member and at least three wheels rotatably coupled to the frame member, wherein the wheels are operable for allowing the counterweight carriage to roll along the roof, wherein the counterweight carriage further includes a steering mechanism coupled to at least one of the wheels and operable for steering the support structure, includes a ballast container mounted to the frame and operable for containing ballast material, and includes beam attachment means disposed at the top of the ballast container for securely coupling to a horizontal beam;

a beam securely coupled to the counterweight carriage at an inward end of the beam and disposed substantially horizontally and transversely to the direction of travel of the counterweight carriage, wherein the beam has an outward end operable for extending outwardly over an edge of the roof;

a center support securely coupled to the beam at a position between the inward and outward ends thereof and operable for supporting the center of the beam, wherein the center support includes a frame having a horizontal frame member disposed transversely to the beam and having a vertical frame member extending upwardly from the center of the horizontal member, wherein the center support further includes two wheels each rotatably coupled to an end of the horizontal frame member and operable for allowing the center support to roll along with the counterweight carriage and beam along the roof in a direction generally transverse to the beam, and wherein the center support further includes attachment means disposed at the top of the vertical frame member for securely coupling to the beam; and means coupled to the outward end of the beam for supporting an object suspended below.

2. A support structure as recited in claim 1 wherein the frame of the center support includes a plurality of sections of metal tubing welded together into a rigid structure, wherein the attachment means of the center support includes a box section of metal tubing welded to the vertical frame member, wherein the axis of the box section extends transverse to the horizontal and vertical frame members of the center support, wherein the cross-section of the box section is selected such that the interior thereof is slightly larger than the external cross-section of the beam, and wherein the attachment means of the center support further includes holes in the box section and the beam and one or more pins insertable into mating holes in the box section and beam to lock the lateral position of the beam with respect to the center support.

3. A support structure as recited in claim 1 wherein the frame and ballast containers of the counterweight carriage includes a plurality of sections of metal tubing and metal plates welded together into a rigid structure, wherein the attachment means of the counterweight carriage includes a box section of metal tubing welded to the top of the ballast container, wherein the axis of the box section extends parallel to the axis of the wheels not associated with the steering mechanism, wherein the cross-section of the box section is selected such that the interior thereof is slightly larger than the external cross-section of the beam, and wherein the attachment means of the counterweight carriage further includes holes in the box section and the beam and one or more pins insertable into mating holes in the box section and beam to lock the lateral position of the beam with respect to the counterweight carriage.

4. A support structure as recited in claim 3 wherein the attachment means of the counterweight carriage includes two box sections welded to a plate that is welded across the top of the ballast container, wherein the axes of the two box sections are aligned, wherein the counterweight carriage further includes a lug welded to and spanning the distance between the two box sections.

5. A support structure as recited in claim 4 further comprising securing means for securing a safety line between the support structure and the building, wherein the securing means includes a safety line coupled at one end to the building and coupled at the other end thereof to the lug on the counterweight carriage.

6. A support structure as recited in claim 1 wherein the steering mechanism of the counterweight carriage includes a sub-frame attached to the axles of the wheels of the steering mechanism, includes a turntable attached between the sub-frame and the frame of the counterweight carriage, and includes a handle coupled to the sub-frame and operable for rotating the sub-frame and associated wheels about the axis of the turntable in order to steer the support structure.

7. A support structure as recited in claim 1 further including ballast material contained in the ballast container of the counterweight carriage.

8. A support structure as recited in claim 1 wherein the means for supporting an object suspended below includes an eye-bolt affixed to the outward end of the beam, includes a carabiner hook coupled to the eye-bolt, and includes cables and associated support structure hanging downward from the carabiner hook to the object.

9. A support structure as recited in claim 1 wherein all wheels include inflated rubber tires.

10. A support structure for suspending a person from the top of a building having a substantially flat roof, said apparatus comprising:

a counterweight carriage including a rigid frame member formed from welded sections of metal tubing and at least three wheels rotatably coupled to the frame member, wherein the wheels are operable for allowing the counterweight carriage to roll along the roof, wherein the counterweight carriage further includes a steering mechanism coupled to at least one of the wheels and operable for steering the support structure, wherein the steering mechanism includes a sub-frame attached to the axles of the wheels of the steering mechanism, a turntable attached between the sub-frame and the frame of the counterweight carriage, and a handle coupled to the sub-frame and operable for rotating the sub-frame and associated wheels about the axis of the turntable in order to steer the support structure, wherein the counterweight carriage further includes a ballast container formed from welded metal plates and mounted to the frame and operable for containing ballast material, includes a box section of metal tubing welded to the top of the ballast container for securely coupling to a horizontal beam, and includes a lug welded to the box section;

a beam securely coupled to the counterweight carriage at an inward end of the beam and disposed substantially horizontally and transversely to the direction of travel of the counterweight carriage, wherein the beam has an outward end operable for extending outwardly over an edge of the roof;

a center support securely coupled to the beam at a position between the inward and outward ends thereof and operable for supporting the center of tne beam, wherein the center support includes a rigid frame welded from sections of metal tubing and having a horizontal frame member disposed transversely to the beam and having a vertical frame member extending upwardly from the center of the horizontal member, wherein the center support further includes two wheels each rotatably coupled to an end of the horizontal frame member and operable for allowing the center support to roll along with the counterweight carriage and beam along the roof in a direction transverse to the beam, and wherein the center support further includes a box section of metal tubing welded to the top of the vertical frame member for securely coupling to the beam;

means coupled to the outward end of the beam for supporting a window washer suspended below, including an eye-bolt affixed to the outward end of the beam, including a carabiner hook coupled to the eye-bolt, and including cables and associated support structure hanging downward from the carabiner hook to the suspended person; and securing means for securing a safety line between the support structure and the building, wherein the securing means includes a safety line coupled at one end to the building and coupled at the other end thereof to the lug on the counterweight carriage.

* * * * *